US005632254A

United States Patent [19]

Kim

[11] Patent Number: 5,632,254

[45] Date of Patent: May 27, 1997

[54] DEVICE FOR ENHANCEMENT OF COMBUSTION

[76] Inventor: Young S. Kim, 4955 Bramhope La., Ellicott City, Md. 21043

[21] Appl. No.: 509,287

[22] Filed: Jul. 31, 1995

[51] Int. Cl.[6] ..... F02M 33/00

[52] U.S. Cl. ..... 123/538

[58] Field of Search ..... 123/536, 537, 123/538, 539; 210/222, 695; 431/1

[56] References Cited

U.S. PATENT DOCUMENTS

| | | | |
|---|---|---|---|
| 5,048,498 | 9/1991 | Cardan | 123/538 |
| 5,063,368 | 11/1991 | Ettehadieh | 123/538 |
| 5,080,080 | 1/1992 | Melendrez | 123/538 |
| 5,254,247 | 10/1993 | Kashani | 123/538 |
| 5,271,369 | 12/1993 | Melendrez | 123/538 |
| 5,451,199 | 9/1995 | Kim et al. . | |
| 5,460,144 | 10/1995 | Park et al. | 123/538 |

*Primary Examiner*—Marguerite McMahon
*Attorney, Agent, or Firm*—Birch, Stewart, Kolasch & Birch, LLP

[57] ABSTRACT

A device comprising a housing having a magnet(s) and a far infrared ray generating composition disposed therein that provides for enhanced combustion of liquid fuels. The device can be attached to the exterior of a fuel line or tank or may be disposed inside the tank. The result is improved efficiency in burning and reduced pollution emissions.

20 Claims, 2 Drawing Sheets

DEVICE FOR ENHANCEMENT OF COMBUSTION

BACKGROUND OF THE INVENTION

1. Field of the Invention

The present invention relates to a device for enhancing the combustion of liquid fuel by the combined application of far infrared rays and magnetic radiation.

2. Description of the Related Art

Several types of devices have been advertised as increasing engine power and reducing exhaust gas pollution. For example, a magnet has been attached to the fuel line of an automobile for improving acceleration of the engine and reducing environmental pollution. However, this device, as well as the other devices previously formed, do not work satisfactorily.

SUMMARY OF THE INVENTION

Accordingly, it is an object of the present invention to provide a device that will enhance combustion.

It is another object of the present invention to provide a device that will increase the power or acceleration of a combustion engine.

It is a further object of the present invention to provide a device that will improve the fuel efficiency of a combustion engine or boiler.

Another object of the present invention is to provide a device that will reduce harmful emissions from a combustion engine or boiler.

These and other objects are achieved by a combustion enhancement device, comprising:

a housing which defines an interior chamber;

at least one magnet disposed within said interior chamber; and a far infrared ray generating composition disposed within said interior chamber.

The device can be attached to the fuel line leading to the combustion engine or boiler, or to the fuel tank itself. Alternatively, the device can be placed inside the fuel tank.

DETAILED DESCRIPTION OF THE INVENTION

Figure 1:
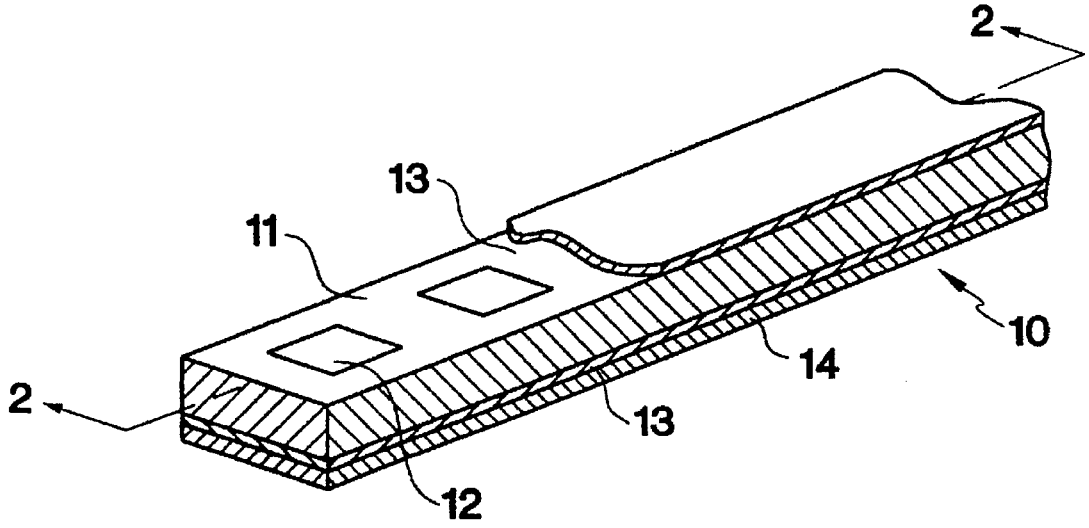
FIG. 1 shows a cutaway perspective view of one embodiment of the present invention.
Figure 3:
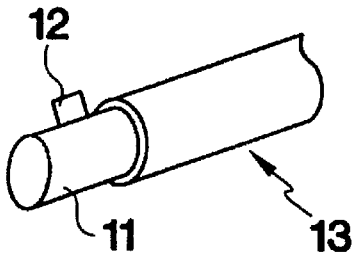
FIG. 3 is a cutaway perspective view of one embodiment of the present invention.
Figure 4:
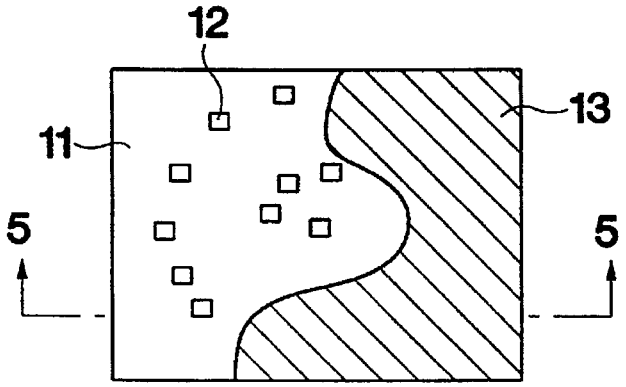
FIG. 4 shows a cutaway top view of one embodiment of the present invention.

The device of the present invention comprises a housing containing therein at least one magnet and a far infrared ray generating composition. The housing can be of any convenient shape and size. For ease of attachment to a fuel line, a tubular shape is preferred. FIG. 1 shows the device 10 having a tubular housing 13 with a substantially rectangular cross-section. A substantially square cross-section is, of course, also suitable and is included within the meaning of the term "substantially rectangular cross-section." For using the device in the interior of a fuel tank, a tubular housing having a substantially circular cross-section is preferred. Such a substantially circular cross-section is shown in FIG. 3. For attaching the device to the exterior of a fuel tank, a plate-like housing is preferred, as is shown in FIG. 4.

As an example of size, a tubular housing may range from 5 to 30 cm and have a cross-sectional area in the range of 1 to 9 cm. A plate-like housing can have a size ranging from 15 to 30 cm×15 to 30 cm, and have a thickness of 0.5 to 3 cm.

The housing can be made out of any suitable material, such as metal or plastic. Preferably, the material is lightweight and has good resistance to road debris, which may be kicked-up during use. Preferably, the housing is made of aluminum, copper, or a rubber. In this context, rubber embraces both natural and synthetic rubbers. The walls of the housing are generally thin so as to minimize its blocking of the magnetic and infrared radiation from the interior of the housing. A thickness of 2 mm or less is typical for the housing wall.

The housing provides an interior compartment for holding at least one magnet and the far infrared ray generating composition. Preferably, a plurality of magnets are contained in the interior chamber. The magnets are preferably arranged with a uniform pattern or spacing. The north pole of the magnets, i.e., the pole from which lines of magnetic flux radiate, is preferably oriented so that when the device is attached, it is directed toward the fuel. Further, the magnets are preferably near or in contact with the housing, and not fully surrounded by the infrared ray generating composition.

In a tubular housing, the magnets are generally arranged along the longitudinal direction of the housing with equal spacing between each magnet. Preferably, the spacing between the magnets is equal to the size of the magnets employed; i.e., each magnet and each space between the magnets is the same distance.

In a plate-like housing, the magnets can be arranged in any desired pattern, including randomly. Preferably, the magnets are arranged in a uniform pattern, such as a square matrix, a circle, multiple concentric circles, a spiral, etc.

Given the overall size limitations on the device for its intended use, the magnets are generally no longer than 5 cm, preferably no longer than 2 cm. A preferred magnet size is a 1 cm×1 cm square magnet as well as a 1.5 cm×1.0 cm rectangular magnet for use in a housing having a substantially rectangular cross-section. Round or circular magnets having a width of 1.0 cm to 1.5 cm are preferred for use in a housing having a substantially circular cross-section, so as to follow the curved wall of the housing.

Although the strength of the magnets is not particularly limited, generally, each magnet exhibits a magnetic flux density between 0.1–0.5 Tesla. Preferably, each magnet exhibits a flux density between 0.22–0.30 T.

An infrared ray generating composition is described in U.S. application Ser. No. 08/203,608, filed Feb. 28, 1994, which is incorporated herein by reference in its entirety. In the present invention, the far infrared ray generating composition should emit infrared light in the wavelength region of from about 4 to 15 microns. The far infrared ray generating composition can be comprised metal oxides. Preferably the far infrared ray generating composition contains $SiO_2$, $Al_2O_3$, CaO, MnO, and $TiO_2$, and optionally Ag and/or Au (hereinafter referred to as the "metal oxide composition"). More preferably the composition comprises about 24–27 parts by weight of $SiO_2$, about 53–55 parts by weight of $Al_2O_3$, about 13–15 parts by weight of CaO, about 2–4 parts by weight of MnO, about 1–3 parts by weight of $TiO_2$, and about 0–2 parts by weight of Ag or Au, and the sum of the amounts of $SiO_2$, $Al_2O_3$, CaO, MnO, $TiO_2$, Ag and Au is 100 parts by weight. Most preferably, the composition contains about 26 parts by weight of $SiO_2$, about 54 parts by weight of $Al_2O_3$, about 14 parts by weight of CaO, about 3 parts by weight of MnO, about 1.7 parts by weight of $TiO_2$, and about 1.3 parts by weight of Ag or Au; the sum of the amounts of $SiO_2$, $Al_2O_3$, CaO, MnO, $TiO_2$, and Ag or Au being 100 parts by weight. Although gold is preferred over silver in terms of performance, silver is much more economical and is thus preferred as the more cost efficient metal. Of course, the two metals can be used together, if desired, in order to account for 2 parts by weight or less of Au and Ag described above.

The ingredients for the metal oxide composition are all commercially available. The ingredients are combined and mixed thoroughly in order to form a homogenous admixture. If desired the ingredients can be ground or milled into a finer powder. Preferably, each of the oxides and metals is in the form of fine grains having an average diameter of from around 5–10 microns.

The far infrared ray generating composition used in the present invention can further comprise a binder. The binder can be a resin or a protein based binder such as gelatins, collagen, etc. A preferred binder is ordinary white glue. The binder, if present, is used in amounts up to 30 parts by weight per 100 parts by weight of the metal oxide composition described above. Preferably, the binder is not more than 20 parts, more preferably not more than 10 parts, and most preferably not more than 5 parts by weight, per 100 parts of the metal oxide composition.

The device according to the present invention can optionally contain a heat shield on the exterior of the housing. The heat shield can cover one or more sides of the device, but should not cover the side of the device that the north pole of the magnets are facing. The heat shield can protect the device from heat and also debris that may be encountered during road use. A heat shield is not normally employed when the device is to be used in a fuel tank since the heat exposure is low and there is no risk of flying debris. The heat shield can be made of any suitable material, including rubber and asbestos, with rubber being preferred. Again, rubber includes both natural and synthetic rubber.

Once the housing is selected, the magnet or magnets and the far infrared ray generating composition are inserted into the compartment. If a tubular housing is used, a convenient method for forming the device comprises attaching the north pole of the magnets to a strip of tape. The tape is then inserted into an open end of the housing and positioned against one of the longitudinal housing walls. The infrared ray generating composition is then added to the compartment through the open end. Preferably a sufficient amount of the composition is added so that the compartment is completely filled. The open end of the housing is then sealed by any appropriate means; i.e., inserting a plug or stopper.

Similarly, if a plate-like housing is selected, the housing can be formed with one open end through which the magnet or magnets and the far infrared ray generating composition are inserted. The opening can then be closed by any suitable means, including crimping the edges together of the opening together or attaching an end piece or cap to the open end.

Turning to the drawings, FIG. 1 shows an aluminum tubular housing 13 having a substantially rectangular cross-section and provided with a rubber heat shield 14 on one side thereof. The permanent magnets 12 are serially arranged along the longitudinal direction of the housing and oriented so that the north pole of each magnet is facing in a transverse direction to the longitudinal direction of the housing. The magnets are also equally spaced from one another, with the spaces being substantially the same length as the magnets themselves. The magnets are surrounded on three sides by the far infrared ray generating composition 11.

Figure 2:
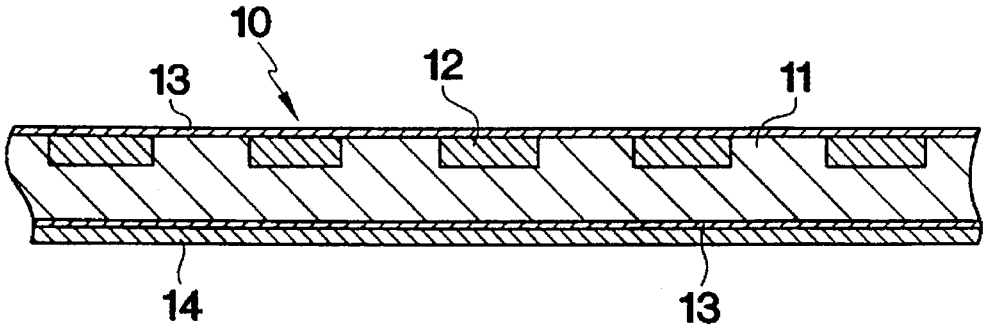
FIG. 2 shows a sectional view of FIG. 1 taken along the line 2—2.

FIG. 2 shows a cross-sectional view of FIG. 1 and all reference numerals have the same meaning as in FIG. 1. The north pole of each magnet 12 is in contact with the housing.

A different embodiment is illustrated in FIG. 3, wherein the aluminum tubular housing 13 has a substantially circular cross-section. Although the magnets 12 are shown as being serially arranged as in FIG. 1, the magnets could have been facing in any outward (transverse) direction. Again the magnets are equally spaced apart and surrounded on three sides by the far infrared ray generating composition. However, no heat shield is present in FIG. 3.

Figure 5:
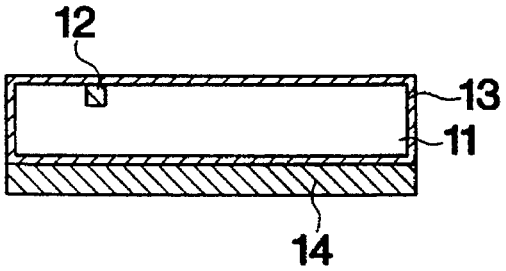
FIG. 5 shows a sectional view of FIG. 4 taken along line 5—5.

Another embodiment is shown in FIGS. 4 and 5. The housing 13 has a plate-like shape and comprises upper and lower major faces. The magnets are arranged in a spiral pattern and with their north poles in contact with the upper major face of the housing 13. The far infrared ray generating composition fills the remainder of the compartment. In FIG. 5, which is a cross-sectional view of FIG. 4, heat shield 14 is shown as being attached to the lower major face of the housing.

The present invention is used by either attaching it to the exterior of the fuel line, fuel tank, or both, of a combustion engine or boiler, or inserting the device into the fuel tank itself. The device can be attached by any means, including tying the device by wrapping a cord around the fuel line or tank and the device, or clamping the device thereto by the use of brackets and/or clamps.

While not wishing to be bound by any theory, Applicant believes that the combined magnetic and far infrared rays radiating from the device affect the fuel molecules and cause some change therein. Perhaps the shape of the molecule is modified or the relative flow of the molecules altered. In any event, when the present invention is used as described above, the following advantages are observed:

- improved fuel efficiency;
- higher and more uniform torque over a broad range of engine speeds;
- improved engine power; and
- more complete combustion with less hydrocarbon, less carbon monoxide, and less nitrogen oxide in exhaust.

The present invention can be used with any liquid fuel-based combustion engine or boiler, etc., and is suitable for use on automobiles, motorcycles, airplanes, boats, and industrial plants. The device is effective with both gasoline and diesel engines.

One or more devices can be used depending upon the particular application and the results desired. For example, a single device as shown in FIG. 1, can be successfully used when attached to the fuel line near the gas tank of a four cylinder car. Alternatively, on an eight cylinder car, two devices are preferred to be attached to the exterior of the fuel line; one being located near the gas tank and one near the engine. For motorcycles, it is more convenient to insert a device, such as illustrated in FIG. 3, into the gas tank itself. The ideal arrangement for a particular engine is thus readily determinable by workers skilled in the relevant art.

EXAMPLE

An emissions test was performed in order to demonstrate one of the effects of the present invention. A 1990 Geo Prizm having a four cylinder 1.6 liter engine was used as the test car. This car had 78,722 miles at the time of the test. The car's emissions were analyzed using a computerized emissions analysis machine and inserting the probe thereof into the car's tail pipe. The inventive device tested corresponded to FIG. 1, and used as the far infrared ray generating composition the most preferred composition described above with gold, instead of silver, as the metal. The composition was in the form of a fine powder admixture with no binder. The test was performed first with no device on the automobile and the engine fully warmed up. The car was then shut off and allowed to cool down. The device was subsequently attached to the fuel line of the car. The test was then performed again, once the engine was fully warmed up. The results were as follows:

| | WITHOUT DEVICE | WITH DEVICE |
|---|---|---|
| Hydrocarbon | 130 ppm | 12 ppm |
| Carbon Monoxide | 0.03% | 0.01% |
| Oxygen | 0.34% | 0.13% |
| Carbon Dioxide | 14.69% | 14.66% |

The invention having been described above, it will be obvious that the same may be varied in many ways. Such variations are not to be regarded as a departure from the spirit and scope of the invention and all such modifications as would be obvious to one skilled in the art are intended to be included within the scope of the following claims.

I claim:

1. A combustion enhancement device, comprising:

a housing which defines an interior chamber;

at least one magnet disposed within said interior chamber; and a far infrared ray generating composition comprising $SiO_2$, $Al_2O_3$, CaO, MnO, $TiO_2$, and Ag or Au disposed within said interior chamber.

2. The device according to claim 1, wherein said composition comprises about 24–27 parts by weight of $SiO_2$, about 53–55 parts by weight of $Al_2O_3$, about 13–15 parts by weight of CaO, about 2–4 parts by weight of MnO, about 1–3 parts by weight of $TiO_2$, and about 0–2 parts by weight of Ag or Au, and the sum of the amounts of $SiO_2$, $Al_2O_3$, CaO, MnO, $TiO_2$, Ag and Au is 100 parts by weight.

3. The device according to claim 2, wherein said housing is made of aluminum.

4. The device according to claim 2, wherein said housing has a tubular shape.

5. The device according to claim 4, wherein said housing has a substantially rectangular shape cross-section.

6. The device according to claim 4, wherein said interior cavity contains a plurality of magnets which are serially arranged along the longitudinal direction of said housing and orientated so that the north pole of each magnet is facing in a transverse direction to the longitudinal direction of the housing.

7. The device according to claim 6, wherein said magnets are equally spaced apart and are facing in the same transverse direction.

8. The device according to claim 7, wherein the north pole of each of said magnets is in contact with one side of the housing.

9. The device according to claim 8, further comprising a heat shield disposed on an exterior surface of said housing.

10. The device according to claim 9, wherein said heat shield is made of rubber.

11. The device according to claim 7, wherein said magnets each have a magnetic flux density of 0.22–0.30 T.

12. The device according to claim 4, wherein said housing has a substantially circular cross-section.

13. The device according to claim 12, wherein said interior cavity contains a plurality of magnets which are serially arranged along the longitudinal direction of said housing and orientated so that the north pole of each magnet is facing in a transverse direction to the longitudinal direction of the housing.

14. The device according to claim 13, wherein said magnets each have a magnetic flux density of 0.22–0.30 T.

15. The device according to claim 2, wherein said housing comprises a first and second major face that are substantially parallel to each other and which form the interior cavity therebetween.

16. The device according to claim 15, wherein said interior cavity contains a plurality of magnets arranged in a uniform pattern and orientated so that the north pole of each of said magnets is facing said first major face of the housing.

17. The device according to claim 16, wherein the north pole of each of said magnets is in contact with said first major face of said housing.

18. The device according to claim 17, wherein said housing is made of synthetic or natural rubber.

19. The device according to claim 18, wherein said magnets are arranged in a spiral pattern.

20. A combustion enhancement device, comprising:

a housing which defines an interior chamber;

at least one magnet disposed within said interior chamber; and a far infrared ray generating composition disposed within and filling said interior chamber.

* * * * *